United States Patent [19]

Total et al.

[11] Patent Number: 4,744,201

[45] Date of Patent: May 17, 1988

[54] STAGING APPARATUS AND METHOD

[75] Inventors: Robert V. Total, Sun Prairie; Timothy G. Mally, Oregon, both of Wis.

[73] Assignee: Oscar Mayer, Madison, Wis.

[21] Appl. No.: 823,898

[22] Filed: Jan. 30, 1986

[51] Int. Cl.[4] ..... B65B 35/30

[52] U.S. Cl. ..... 53/448; 53/493; 53/532; 53/542; 53/543; 198/420; 198/425; 198/456; 414/28

[58] Field of Search ..... 53/443, 147, 448, 202, 53/500, 531, 532, 534, 537, 539, 540, 542, 543, 493, 498; 198/419, 420, 425, 437, 456; 414/28

[56] References Cited

U.S. PATENT DOCUMENTS

| | | | |
|---|---|---|---|
| 1,586,544 | 6/1926 | White | 414/28 X |
| 2,661,103 | 12/1953 | Fay et al. | 53/500 X |
| 3,290,859 | 12/1966 | Talbot | 53/534 |
| 3,412,874 | 11/1968 | Shiffer | 53/500 |
| 4,226,073 | 10/1980 | Rose et al. | 53/532 |
| 4,429,512 | 2/1984 | Pegon | 53/534 |
| 4,555,892 | 12/1985 | Dijkman | 53/537 X |

*Primary Examiner*—Robert L. Spruill
*Assistant Examiner*—Steven P. Weihrouch
*Attorney, Agent, or Firm*—Joseph T. Harcarik; Thomas R. Savoie; Daniel J. Donovan

[57] ABSTRACT

An apparatus and method are provided for staging a plurality of products into a grouping of a desired number of the products having a given center-to-center spacing therebetween. The staging assembly includes an endless track that indexes in order to feed, without gaps, a desired number of products thereonto, which endless track off-feeds in a generally constant manner in order to provide, in association with the takeaway speed of a receiving conveyor, the desired center-to-center spacing.

6 Claims, 4 Drawing Sheets

12
21a
25
34a
34b
34c
34d
39
35
19
33
41
42
34
36
37
38
26

STAGING APPARATUS AND METHOD

BACKGROUND AND DESCRIPTION OF THE INVENTION

The present invention generally relates to staging a flow of a plurality of products into a staged outflow of products that are in a desired patterned grouping which includes a specific number of products having a specific desired spacing therebetween. The apparatus and method of the present invention are particularly suitable for staging a plurality of stacks of sliced food products, especially sliced sausage products such as those of the so-called luncheon meat variety including salami, summer sausage, bologna, ham and the like. More particularly, the invention relates to an apparatus and method for receiving a flow of a plurality of products having flow characteristics different from the desired pattern and then staging such flow of products into a patterned grouping of products that includes a specified number of products having a specified spacing therebetween, which desired patterned grouping is advantageously arranged to substantially correspond to the number and spacing of a plurality of packaging container openings or bubbles, a plurality of which are included within a sheet utilized in packaging the products into the containers or bubbles.

During the manufacturing and packaging of products, including food products such as stacks of sliced sausage, products are often provided as an out-feed from a manufacturing or processing station that is not particularly consistent, especially from the point of view of spacing between the products, and at times there is a need to stage such inconsistently spaced flow of products into a desired pattern. A typical pattern in this regard is that of the spacing among packaging containers or bubbles of packaging sheeting units. For example, in the manufacture and packaging of food products such as sliced sausage products, large sticks or loaves of sausage or other product are cut into slices by a high-speed rotary slicer which discharges the slices in loosely arranged stacks of a desired weight, and there is a need to transfer these stacks of slices into a container or bubble within which the slices are subsequently packaged and sealed. Typically, in order to take advantage of economies of scale, the packaging containers are provided in the form of a sheet or unit having a plurality of containers or bubbles which are later severed from each other after packaging has been substantially completed. Product flow from slicers and the like provide a flow that consists of products which are not consistently spaced, and at times it is necessary to manually fill or assist in filling the products into the individual containers or bubbles of the packaging units.

In the example of the packaging of sliced food products, sticks or loaves thereof are frozen and cut into slices by a high-speed rotary slicer which discharges the slices in loosely arranged stacks of a desired weight. The slices of each stack typically then must be arranged into neater vertical alignment for insertion into snug or close-fitting cavities within a substantially rigid plastic tray which is later covered, sealed and severed in order to provide individual finished packages. In a copending and commonly owned patent application entitled "Stack Handling Method and Apparatus", an arrangement is described for simultaneously lifting and transporting a plurality of products having desired spacing therebetween and depositing that grouping of products in substantially simultaneous fashion into a plurality of package compartments or bubbles included in a single packaging sheet. In arrangements such as these, the plurality of products are arranged in a single-file type of grouping that is arranged for movement which is longitudinal with respect to the grouping, which brings with it the advantage of conveying the products in a substantially constant longitudinal direction. However, arrangements such as these require that, prior to lifting and transporting of the entire longitudinally oriented group of products, the products must be precisely spaced with respect to each other, such spacing corresponding to the spacing between the plurality of packaging compartments or bubbles of the packaging sheet. If proper alignment is not achieved, the products will not be properly located within the cavities or bubbles, and the products can be damaged by the transport mechanism.

Of particular interest with respect to the function of providing precise positioning between longitudinally spaced products is the need for such a function in connection with mechanized and automated food processing operations leading to providing packaged food products that have uniform consistency and that have a clean, damage-free appearance which promotes consumer confidence in the product while at the same time reducing the labor intensity of these types of processing operations. One such type of food product that has received considerable attention in this regard is sliced luncheon meat that is packaged in stacks of meat slices within a packaging container or bubble. Typically, luncheon meat is prepared in these operations in large sausage sticks or loaves, and these large products are then loaded into an automatic slicing apparatus which automatically roughly stacks and weighs groups of slices to provide them as a flow of meat slice stacks. Such meat slice stacks are suitably conveyed for subsequent processing, handling and packaging. Using one or more such automatic slicing machines provides a flow of stacks of products that are not alway uniformly spaced and that cannot be easily adjusted in order to provide a spacing of the type that is needed for simultaneous insertion of groups of product stacks into a sheet of packaging bubbles or the like. Typically, such automatic slicers cannot be fully synchronized to provide a consistent flow of stacked products. Also, gaps are inherently developed due to the time it takes to reload the slicer with a fresh stick or loaf.

The present invention takes these various factors into consideration and responds to the needs attendant thereto by providing an apparatus and method for accepting a flow of products on demand from a generally unsynchronized supply thereof, such as is provided by unsynchronized automatic meat slicers having interrupted outputs, and staging that flow of products into a discharge pattern that corresponds to a desired longitudinal spacing between products arranged in longitudinal groupings of flowing products. The invention finds special application in connection with staging a continuous plurality of groupings of a flow of products that are stacks of meat slices. The invention includes a multiplicity of generally parallel staging lines that receive the unsynchronized flow of products. One staging line receives the unsynchronized flow and transforms same into precisely spaced groupings of a desired number of products while another staging line deposits a precisely aligned grouping of a specific number of products onto a takeaway conveyor assembly to thereby complete achievement of an important aspect of the invention. Each staging line is controlled such that it indexes to onfeed movement only in response to positioning of a product at an index initiating location. Off-feed of spaced product groups is carried out in timed arrangement with a takeaway conveyor assembly in order to provide a grouped flow of products on the takeaway conveyor assembly that is of the desired spacing and staging.

It is accordingly a general object of the present invention to provide an improved product staging apparatus and method.

Another object of the present invention is to provide an improved apparatus and method for receiving on demand an unsynchronized flow of products and staging those products for discharge in a predetermined pattern.

Another object of present invention is provide an improved staging apparatus and method for use in connection with the simultaneous packaging of groups of products into spaced cavities of a sheet of packaging material.

Another object of this invention is to provide an improved apparatus and method for transforming an unsynchronized flow of sliced meat products from an automatic slicer or slicers into a synchronized flow of product groupings.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
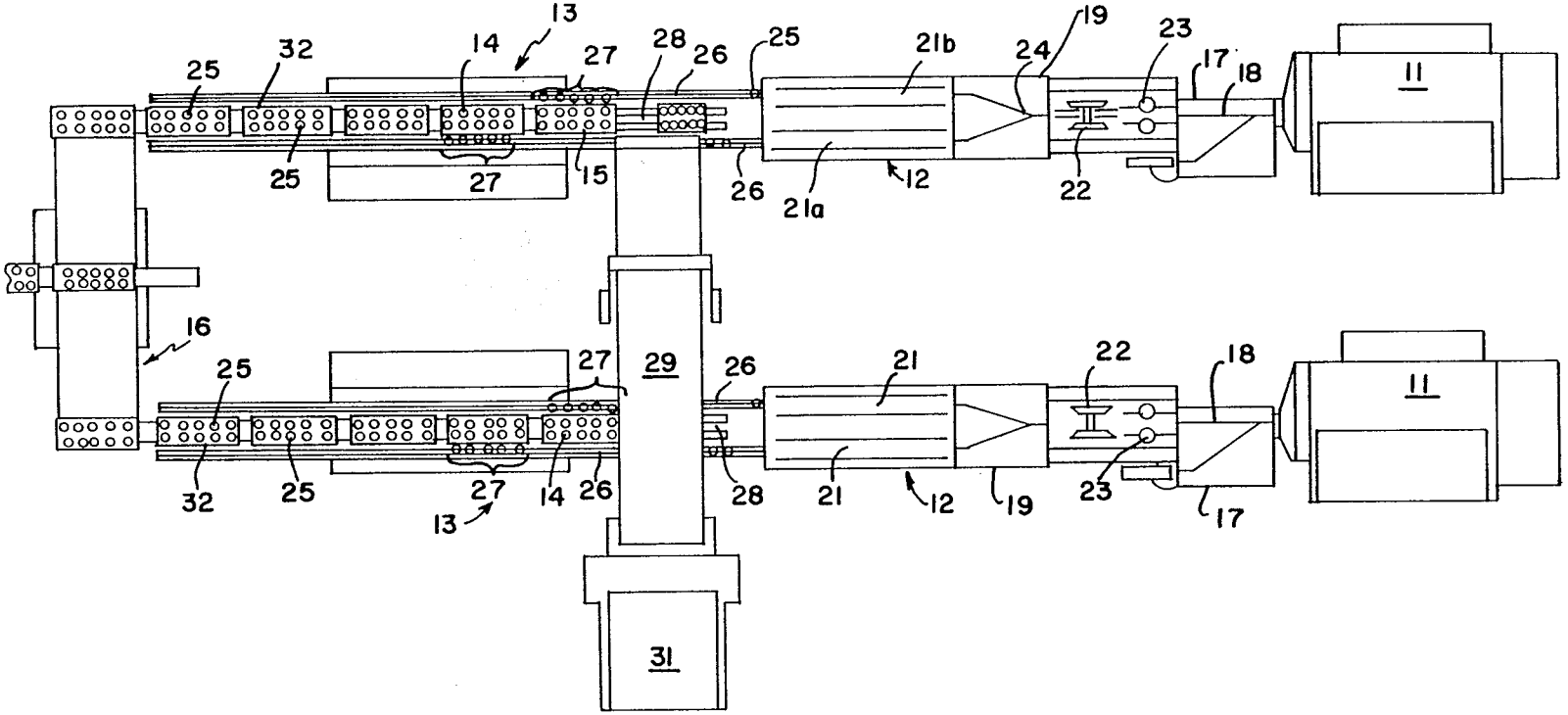
FIG. 1 is a generally schematic plan illustration of a packaging line including a staging apparatus according to this invention.

FIG. 1 illustrates a line that is suitable for slicing large sticks or loaves of sausages and the like into weighed stacks, neatening those stacks and staging them into groups for transference of the groups of products into sheets including packaging bubbles, and thereafter transporting the filled bubbles for subsequent closure and sealing. Two automatic slicers 11 are shown feeding each of two different staging assemblies, generally designated as 12. Each staging assembly 12 feeds a stack handling apparatus, generally designated as 13 and which is described in detail in the copending application entitled "Stack Handling Method and Apparatus", the disclosure of which is incorporated by reference hereinto. Each stack handling apparatus 13 fills spaced cavities 14 of packaging sheets 15, after which the filled packaging sheets are fed to an accumulator conveyor 16, after which they are suitably closed with bases or closure members and are sealed, labeled and trimmed as necessary in order to provide a completed packaged product, typically including a single stack of food slices.

Shown positioned between each automatic slicer 11 and each staging assembly 12 is a diverter device 17 of generally known construction which automatically rejects product stacks that are not acceptable, such as being off-weight, with acceptable stacks moving along lane 18. A flow switching diverter 19 directs the flow of product stacks to one of the two illustrated generally parallel staging lines 21, **21*a*, 21*b*. If the product stacks being processed are of a type that is not consistently neatly stacked by the automatic slicer 11, then it is desirable to include a neatening assembly 22 such as the illustrated single-wheel rotary stacker upstream of the flow of product stacks to the staging assembly 12. A detector device 23, such as a photo eye detector, provides an output signal when an acceptable product stack has reached a location upstream of a switching location 24 of the flow-switching diverter 19. Such output generated at the detector device 23 provides a count which programs the flow-switching diverter 19 to alternately feed a desired number of stacks (five being illustrated in the drawings) to the left staging line 21*a* and then the same number of stacks to the right staging line 21*b***.

Each staging assembly 12 provides an output of products 25 onto a takeaway conveyor 26, such product outflow alternating between passage onto alternating takeaway conveyors 26, the products 25 being in staged groups 27 of products that are of a desired count (five being illustrated) and of a desired spacing therebetween (such as a spacing of 10 inches from center-to-center of adjacent products 25). Such staged groups 27 have an orientation corresponding to that of the spaced cavities 14 of the packaging sheets 15, and the stack handling apparatus 13 lifts the staged grouping 27 as a unit and deposits the staging grouping 27 into one of the rows of spaced cavities 14, as generally illustrated in FIG. 1.

The empty packaging sheets 15 are supplied to a delivery conveyo 28 longitudinally positioned between the takeaway conveyors 26 by a sheet feeding device 29 which provides a continuous supply of empty packaging sheets 15 from a packaging sheet denesting device 31. Filled packaging sheets 32, which include products 25, are then passed to the accumulator conveyor 16 for further operations a needed.

Figure 2:
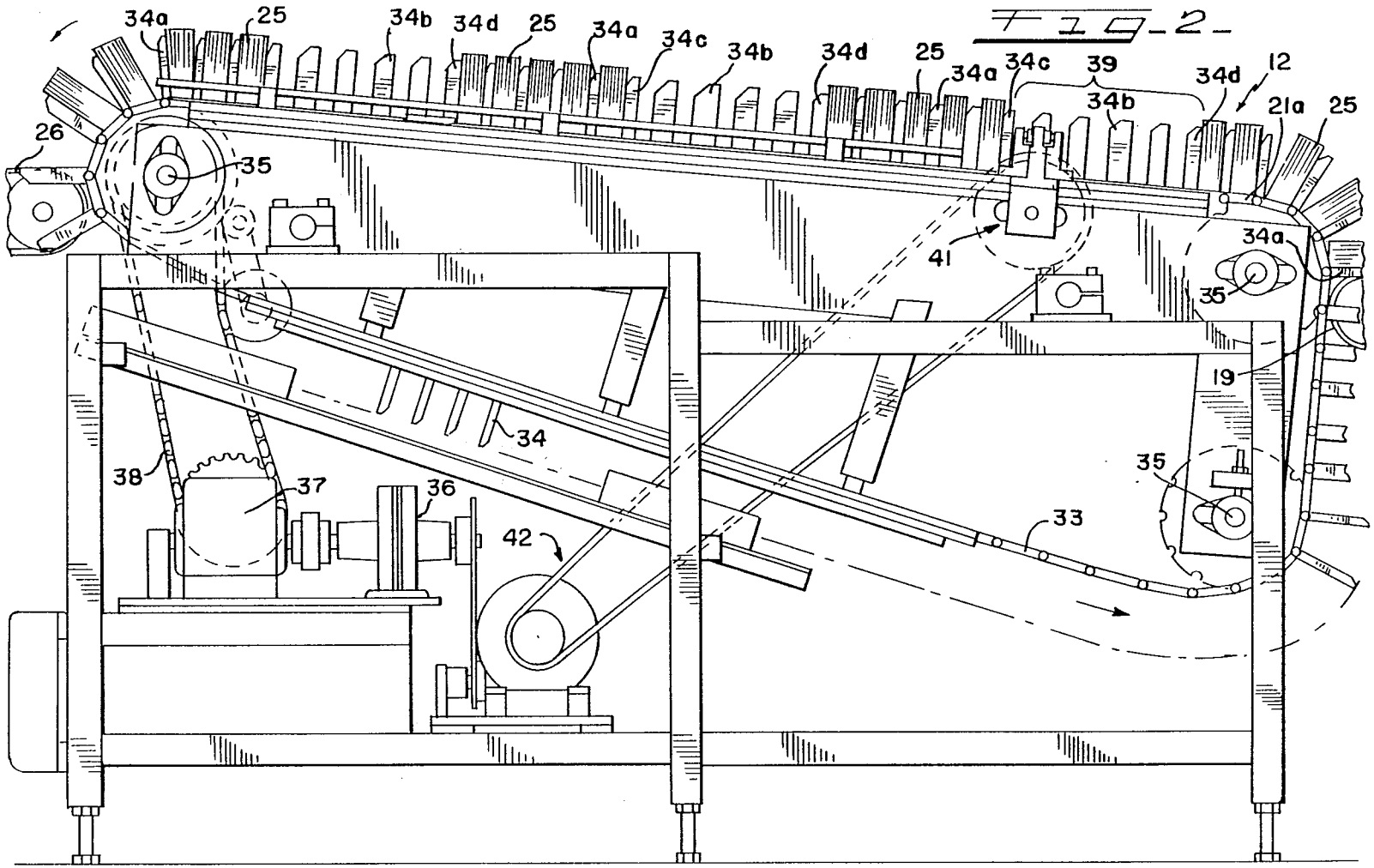
FIG. 2 is side elevational view of the preferred staging apparatus according to this invention.
Figure 3:
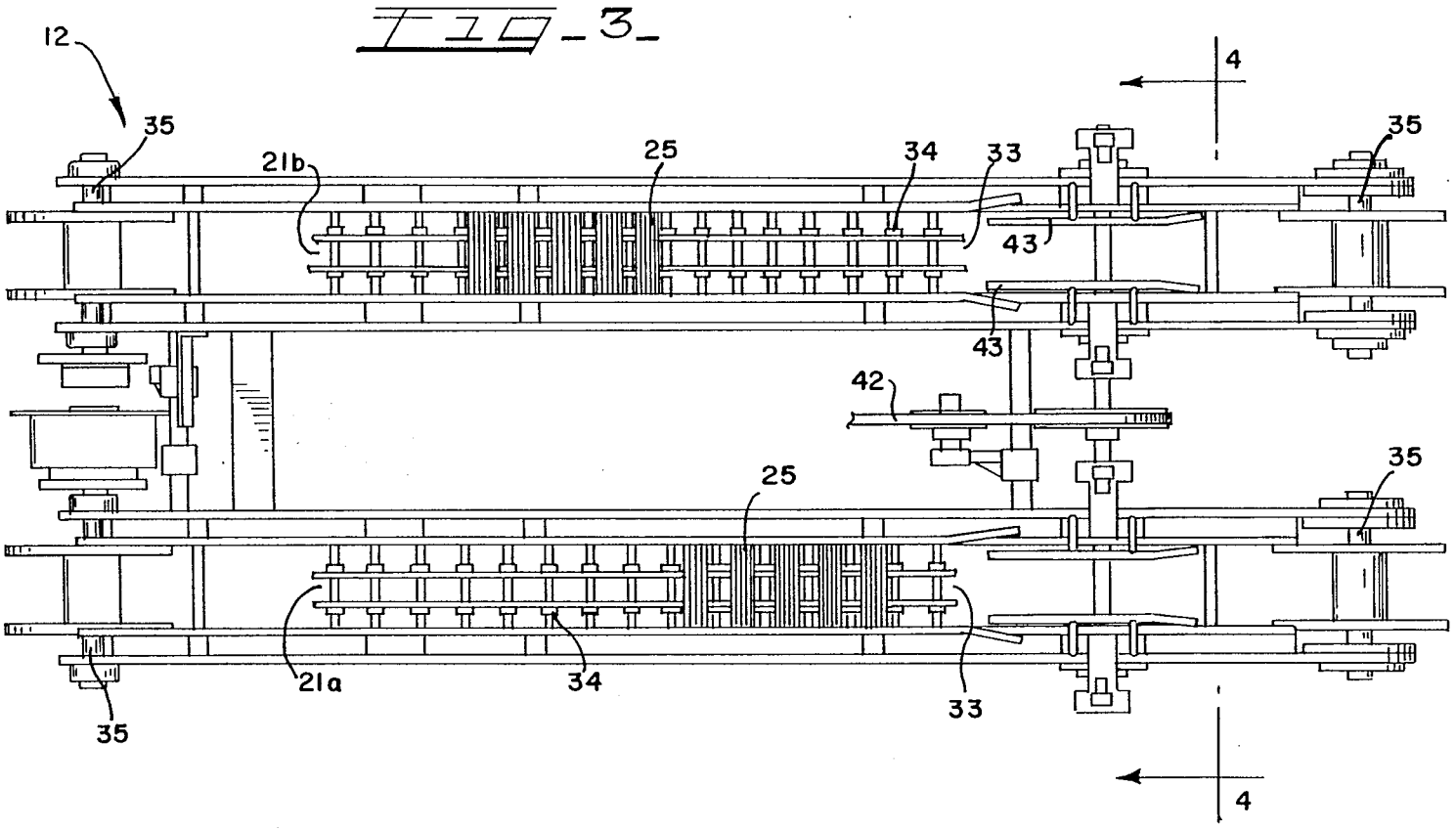
FIG. 3 is a top plan view of the apparatus generally illustrated in FIG. 2.
Figure 4:
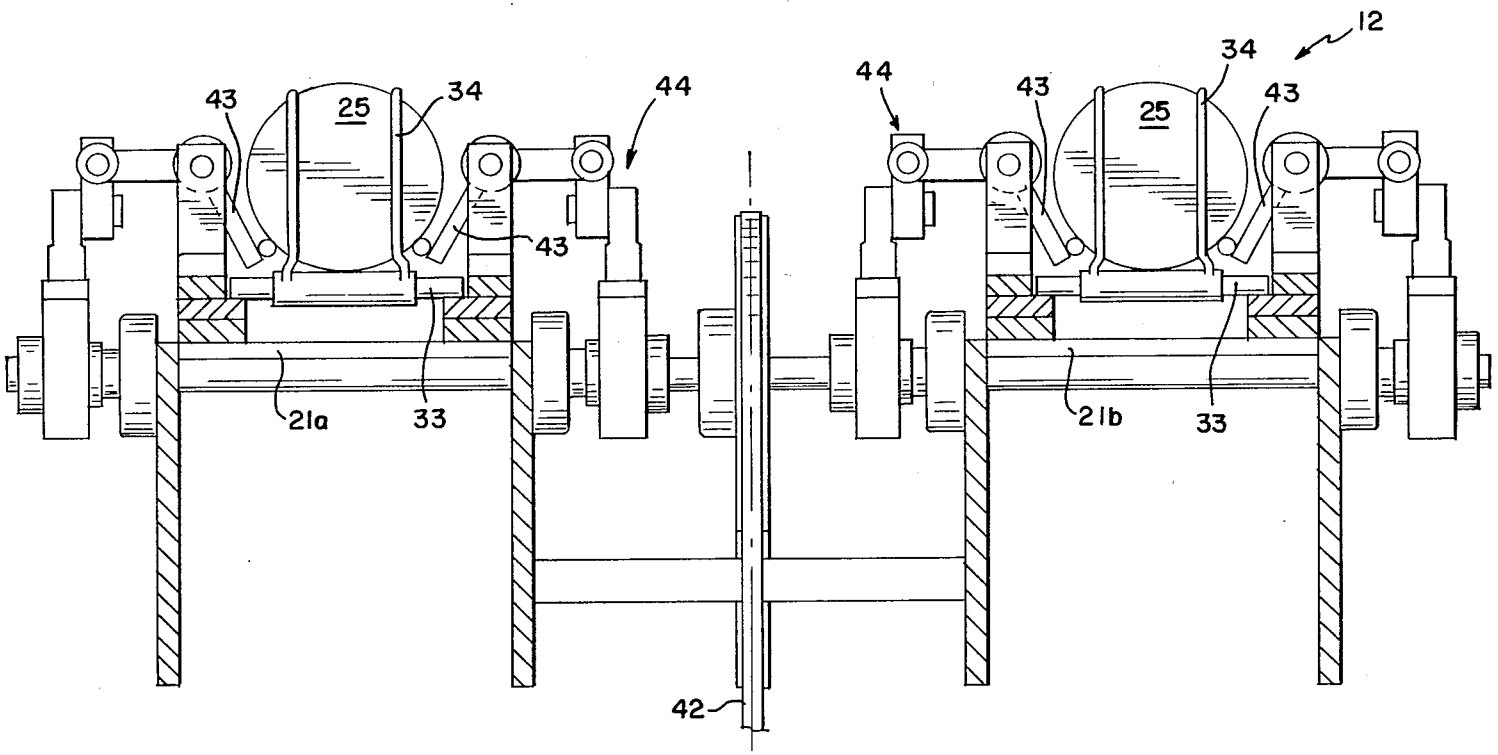
FIG. 4 is a transverse cross-sectional view of the staging assembly of FIGS. 2 and 3, generally along the line 4—4 of FIG. 3.

The preferred stack handling apparatus 12 is more particularly illustrated in FIG. 2, FIG. 3 and FIG. 4. Each staging line, 21, **21*a*, 21*b* of the staging assembly 12 includes an endless flight or track 33 having a plurality of outwardly projecting support tines 34 between which the products 25 are positioned while they are on the staging assembly 12. Each endless track 33 is mounted along suitable rotatable shafts 35, and each endless track 33 is driven therealong by drive assemblies suitable for independently driving each of the endless tracks 33 to stage the stacks 25 and to move grouped stacks off of the endless track 33 and onto the takeaway conveyor 26 as the staged groups 27. Such may be accomplished, for example, by drive assemblies incuding appropriate motor and clutch arrangements and/or a servomotor or hydraulic assembly suitable for imparting driving movement to the endless tracks 33. Exemplary drive assemblies may include a drive motor, a clutch 36, an index box 37 and a drive chain 38**.

Support tines 34 are arranged in groupings to provide product-receiving slots that define a plurality of product-receiving groupings. In the embodiment illustrated in FIG. 2, each grouping of product-receiving spaces is a grouping of five spaces, which corresponds to the number of longitudinally aligned spaced cavities 14 in each of the empty packaging sheets 15.

In operation, the passage of a product 25 to the detector device 23 programs the drive assembly to actuate the index box 37 to thereby move the endless track 33 in a generally clockwise direction as illustrated in FIG. 2 immediately after that stack 25 that had been detected at the detector device 23 reaches the endless track 33 when one of its support tines 34a is poised for lifting engagement with that product 25 upon indexing of the endless track 33. Each such index of the endless track 33 moves the endless track 33 for a length substantially equal to the spacing between adjacent tines 34. Indexing occurs only in response to programmed output resulting from the input of a product 25 having been present at the detector device 23. Consequently, while the group of products 25 are being infed onto the endless track 33, this indexing will occur only when a product 25 is positioned at the onfeed tine 34*a*. After the desired number of index movements have occurred (five being illustrated), then the flow-switching detector 19 is actuated such that its switching location 24 transfers the flow of products from, for example, the left staging line 21*a* to the right staging line 21*b*. The right staging line 21*b* then proceeds through the desired number of indexes (five being illustrated) in response to programming generated by the presence of products at the detector device 23. Indexing of products onto the endless tracks 33 continues to alternate between the track of the left staging line and the track of the right staging line for so long as product continues to reach the input tine 34*a*.

After the groups of products (five products per group being illustrated) are indexed onto the endless track 33, they continue to proceed along the staging line 21. When desired, the driving assembly continuously moves the endless track 33, for example by maintaining engagement of the clutch 36, until such time as all of the products within the grouping have been off-fed from the staging line 21 and onto the takeaway conveyor 26. The speed of such movement of the endless track 33 is chosen such that, when combined with the speed of movement of the takeaway conveyor 26, each product 25 of the product group being thus off-fed from the staging line 21 will be spaced apart by a predetermined distance so as to provide the desired staged grouping 27. After the last product of the grouping is off-fed from the staging line 21 onto the takeaway conveyor 26, movement of the endless track 33 stops.

Because of this movement of the endless track 33 that is needed to accomplish this off-feed operation, the same number of support tines 34 at the onfeed end have proceeded in a generally counterclockwise direction in order to create the illustrated gap of empty product-receiving spaces 39. Accordingly, movement of each endless track 33 or staging line 21 can be summarized as indexed movement through a desired number of index positions in response to the presence of products to accomplish onfeed, followed by generally continuous movement of the endless track 33 or staging line 21 through the same number of between-tines spacing in order to accomplish off-feed of the group of products. Also, the staging assembly 12 and its drive assembly are combined such that when the left staging line 21*a* is in its onfeed, indexing mode, the right staging line 21*b* is in its off-feed mode or in a dwell mode if the off-feed operation on the right staging line 21*b* has been completed before the onfeed operation is completed on the left staging line 21*a*.

The illustrated embodiment includes a further feature whereby the staging assembly 12 can handle products of two different thicknesses. More particularly, the support tines 34 can be provided with differing thicknesses. While each of the support tines are spaced with a constant pitch therebetween, support tines 34*a* are the narrowest tines and accommodate greater thickness products. Lesser thickness products are accommodated between thicker tines 34*b*. When the thicker product is being staged by the apparatus, the spaces between the thicker tines 34 remain empty. Conversely, when the thinner products are being staged by the apparatus, the spaces between the thinner tines 34*a* remain empty. Also provided are transition tines 34*c* which are of intermediate thickness so as to be able to accommodate a thicker product in front thereof and the thinner product in back thereof. Further intermediate tines 34*d* are provided which are of intermediate thickness and are positioned to accommodate thinner products in front thereof and thicker products in back thereof.

During the time that the products are being moved along the upper rung of the endless track 33, an operator has time, if needed, to replace damaged product with good product or to enhance the neatness of individual slices of a product stack in the event that a stack is not of satisfactory neatness. When desired, imparting neatness to product stacks on the staging assembly can be aided by providing a neatener or shaker assembly, generally designated as 41, which is operated by a suitable drive assembly 42. Shaker assembly 41 includes shaker bars 43 for engaging products 25, preferably below the center thereof, such engagement being of a generally vibratory or rapid back and forth motion in order to 3ostle individual slices into alignment with each other. A shaker mechanism, generally designated as 44, imparts the desired vibratory movement to the shaker bars 43 in response to energy provided by way of the drive arrangement 42.

It will be understood that the embodiments of the present invention which have been described are illustrative of some of the applications of the principles of the present invention. Numerous modifications may be made by those skilled in the art without departing from the true spirit and scope of the invention.

We claim:

1. An apparatus for staging an inflow of a plurality of products into a staged outflow of groups of products, which staged outflow groups are of a desired pattern and wherein said products consists of compiled, separable, slices, said apparatus comprising:

means for onfeeding a flow of a plurality of products having a flow characteristics different from a desired patterned grouping of the products, which desired patterned grouping of the products includes a specific number of the products having a specific spacing therebetween;

a multiplicity of generally parallel staging lines downstream of said flow onfeeding means, each said staging line having means for receiving the onfeed flow of products from said flow onfeeding means and for translating the products along an elongated conveyor-like pathway in a direction away from said flow onfeeding means wherein each said staging line includes an endless track having a plurality of outwardly projecting support tines that provide a plurality of product receiving spaces, wherein said support tines are grouped on each of said staging lines according to tines of differing thicknesses, with groups of tines having a larger relative tine thickness forming product receiving spacpes of a smaller relative size and other groups of tines having a smaller relative tine thickness forming product receiving spaces of a larger size and further, wherein said group of tines are spaced to allow selective utilization depending upon the size of the product to be staged, and wherein one of said generally parallell staging lines is in a product onfeed mode when another of said generally parallel staging lines is in a product off-feed mode a diverter means upstream of said staging lines for alternately feeding groups of the products between said multiplicity of generally parallel staging lines;

a detector device upstream of said staging lines for programming an indexing operation of said flow onfeeding means in response to detection of a product at said detector device;

staging line control means for regulating movement of each said staging line to the extent that the products of the onfeed flow are repositioned with respect to each other into the desired patterned grouping including the specific number of the products having the speicific spacing therebetween and further comprising means for off-feeding the specific number of the products at a speed which; in cooperation with means for driving a takeaway conveyor assembly at a selected speed, adjusts the spacing between the products to said specific spacing therebetween; and a takeway conveyor assembly downstream of an off-feed area of each said staging line, each said takeaway conveyor assembly having means for receiving the patterned grouping of products.

2. The staging apparatus according to claim 1, wherein each said staging line further comprises an endless track having a plurality of outwardly projecting support tines that provide a plurality of product receiving spaces, and wherein said indexing operation moves through one of said product receiving spaces.

3. The staging apparatus according to claim 1, wherein a shaker assembly is positioned along said staging line for engaging products being translated therealong.

4. A method for staging an inflow of a plurality of products into a staged outflow of groups of products, which staged outflow groups are of a desired pattern and wherein said products consist of compiled, separable slices, said method comprising:

onfeeding a flow of a plurality of products having onfeed flow characteristics different from a desired patterned grouping of products, which desired patterned grouping includes a specific number of products having specific spacing therebetween, said onfeeding step being alternately onto one of a multiplicity of generally paralleled staging lines;

indexing said onfeeding flow of products upstream of the multiplicity of generally parallel staging lines;

receiving the onfeed flow of products onto the staging line and translating the products along an elongated conveyor-like pathway thereof;

regulating movement of the staging line to the extent that the products of the onfeed flow are repositioned with respect to each other into the desired patterned grouping of a specific number of products having a specific spacing therebetween wherein said regulating movement procedure includes indexing one of the staging lines through an onfeed mode and generally simultaneously moving another of the staging lines through said off-feeding step; and off-feeding the grouping of products from the staging line onto a takeaway conveyor assembly, and moving the takaway conveyor assembly at a selected speed at which the grouping of products are fed onto the takeaway conveyor assembly to said desired patterned grouping of the specific number of products having the specific spacing therebetween.

5. The staging method according to claim 4, wherein said onfeeding flow step includes stacking slices into the products and providing the products in a non-uniform flow sequence, and further including a step of supplying packaging sheets having cavities spaced from each other according to said desired pattern and removing said patterned grouping of products from the takeaway conveyor and depositing same into said spaced cavities.

6. The staging method according to claim 4, wherein said indexing operation includes moving the staging line for a distance generally corresponding to the thickness of a single product.

* * * * *